US009285147B1

(12) United States Patent
Quesada Saborio

(10) Patent No.: US 9,285,147 B1
(45) Date of Patent: Mar. 15, 2016

(54) RELOCATABLE REFRIGERATION SYSTEM WITH PENDULUM WITHIN SEPARATOR AND ACCUMULATOR CHAMBERS

(76) Inventor: Carlos Quesada Saborio, San José (CR)

( * ) Notice: Subject to any disclaimer, the term of this patent is extended or adjusted under 35 U.S.C. 154(b) by 732 days.

(21) Appl. No.: 12/807,817

(22) Filed: Sep. 14, 2010

Related U.S. Application Data

(60) Provisional application No. 61/276,604, filed on Sep. 14, 2009, provisional application No. 61/276,605, filed on Sep. 14, 2009, provisional application No. 61/276,606, filed on Sep. 14, 2009.

(51) Int. Cl.
*F25B 1/00* (2006.01)
*F25B 43/00* (2006.01)
*F25B 43/02* (2006.01)

(52) U.S. Cl.
CPC ..... *F25B 43/006* (2013.01); *F25B 43/02* (2013.01)

(58) Field of Classification Search
CPC ..... F25B 2400/03; F25B 2400/16; F25B 43/006; F25B 43/02; F25B 43/04; F25B 43/043; B01D 17/0214; B01D 21/2405; B01D 21/2444
USPC ..... 62/83, 298–299, 448, 498, 503; 210/519, 520, 537, 539
See application file for complete search history.

(56) References Cited

U.S. PATENT DOCUMENTS 3,662,582 A 5/1972 French
3,692,100 A 9/1972 Gallagher, Jr.
3,740,964 A * 6/1973 Herweg ..... 62/262
4,341,088 A 7/1982 Mei et al.
4,349,489 A 9/1982 Gaget
4,397,331 A 8/1983 Medlar
4,860,993 A 8/1989 Goode
5,347,817 A * 9/1994 Kim ..... 62/471
6,223,555 B1 * 5/2001 Schroeder et al. ..... 62/503
6,250,602 B1 6/2001 Jansen
6,272,867 B1 8/2001 Barrash et al.
(Continued)

FOREIGN PATENT DOCUMENTS

DE 2209329 9/1972
DE 2209325 9/1973
(Continued)

*Primary Examiner* — Jonathan Bradford
*Assistant Examiner* — Orlando Aviles Bosques
(74) *Attorney, Agent, or Firm* — James Creighton Wray; Meera P. Narasimhan

(57) ABSTRACT

A refrigeration system has a refrigeration control assembly and separate compressor-driver, condenser and evaporator assemblies connected by refrigerant lines to the refrigeration control assembly. The assemblies are relocatable with respect to each other in parallely, longitudinally or angularly related portions. The refrigeration control assembly has multiple ports with quick disconnect sealing joints to the refrigerant lines. The refrigeration control assembly is equipped to connect supplemental compressor, condenser and evaporator assemblies and independent condenser and evaporator units. The refrigerant control valves with the possible exception of expansion and pressure control valves at an evaporator are in the refrigerant control assembly, which also holds the liquid filter, the liquid accumulator, the suction accumulator and the oil separator. The liquid accumulator, suction accumulator and oil separator have cylindrical chambers and rotatable pendulums with passageways and openings to permit flow of the desired fluids at any orientation.

18 Claims, 13 Drawing Sheets

(56) References Cited

U.S. PATENT DOCUMENTS

| | | | |
|---|---|---|---|
| 6,279,333 | B1 | 8/2001 | Cilli et al. |
| 6,332,327 | B1 | 12/2001 | Street et al. |
| 6,481,216 | B2 | 11/2002 | Simmons et al. |
| 6,564,563 | B2 | 5/2003 | Goth et al. |
| 6,637,452 | B1 | 10/2003 | Alman |
| 6,644,056 | B2 | 11/2003 | Goth et al. |
| 6,647,735 | B2 | 11/2003 | Street et al. |
| 6,662,588 | B2 | 12/2003 | Houk et al. |
| 6,688,125 | B2 | 2/2004 | Okamoto et al. |
| 6,698,218 | B2 | 3/2004 | Goth et al. |
| 6,742,343 | B2 | 6/2004 | Matonog et al. |
| 6,848,670 | B2 | 2/2005 | Haunhorst |
| 6,973,794 | B2 | 12/2005 | Street et al. |
| 7,000,422 | B2 | 2/2006 | Street et al. |
| 7,013,655 | B2 | 3/2006 | Des Champs |
| 7,047,753 | B2 | 5/2006 | Street et al. |
| 7,080,521 | B2 | 7/2006 | Ludwig et al. |
| 7,228,691 | B2 | 6/2007 | Street et al. |
| 7,254,956 | B2 | 8/2007 | Matonog et al. |
| 7,260,946 | B2 | 8/2007 | Ludwig et al. |
| 7,266,961 | B2 | 9/2007 | Ludwig et al. |
| 7,270,278 | B2 | 9/2007 | Street et al. |
| 7,320,225 | B2 | 1/2008 | Street et al. |
| 7,406,834 | B2 | 8/2008 | Williams |
| 7,448,409 | B2 | 11/2008 | Micheel |
| 7,461,516 | B2 | 12/2008 | Leadingham et al. |
| 2006/0117773 | A1 | 6/2006 | Street et al. |
| 2007/0125528 | A1 | 6/2007 | Fakheri |
| 2007/0186569 | A1 | 8/2007 | Street et al. |
| 2012/0160465 | A1 | 6/2012 | Webb |

FOREIGN PATENT DOCUMENTS

| | | |
|---|---|---|
| DE | 3815647 | 12/1988 |
| DE | 202008006379 | 7/2008 |
| EP | 0640803 | 3/1995 |
| EP | 1840494 | 10/2007 |
| GB | 1390782 | 4/1975 |
| JP | 2002153931 | 5/2002 |
| JP | 2004218954 | 8/2004 |
| WO | WO 89/06774 | 7/1989 |

* cited by examiner

RELOCATABLE REFRIGERATION SYSTEM WITH PENDULUM WITHIN SEPARATOR AND ACCUMULATOR CHAMBERS

This application claims the benefit of U.S. Provisional Application Nos. 61/276,604, 61/276,605 and 61/276,606, filed Sep. 14, 2009, which are hereby incorporated by reference in their entireties. This application incorporates by reference the disclosures of U.S. application Ser. No. 12/657,352 filed Jan. 19, 2010, Ser. No. 12/220,074 filed Jul. 21, 2008, Ser. No. 12/590,473 filed Nov. 9, 2009 and U.S. Pat. No. 7,614,242.

DETAILED DESCRIPTION OF THE DRAWINGS

Figure 1:
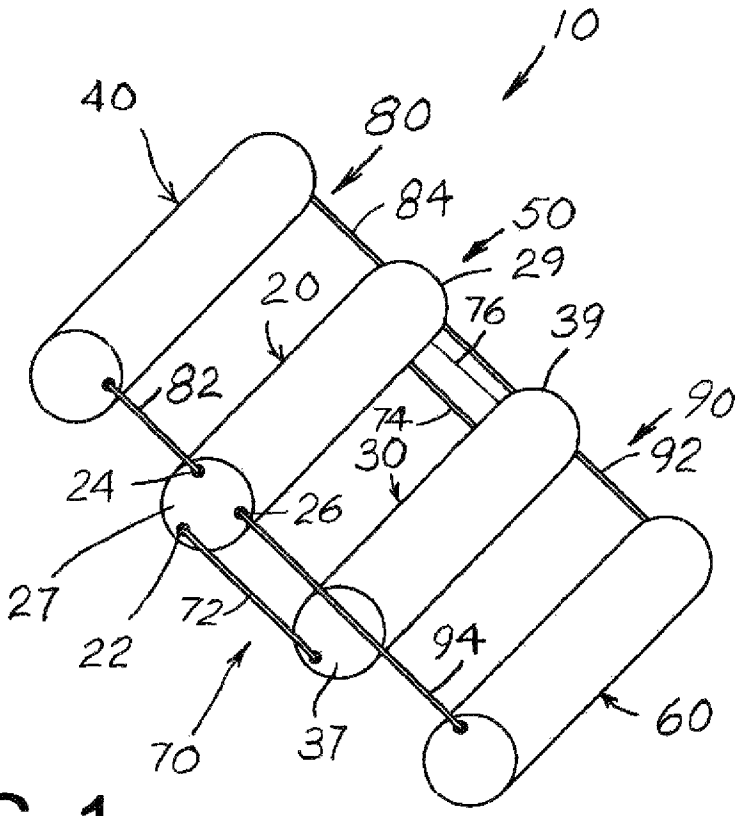
FIG. 1 schematically shows a parallel horizontal arrangement of refrigerant components.

FIG. 1 schematically shows a parallel horizontal arrangement 10 of refrigerant components. Components include a refrigerant control assembly 20, a compressor assembly 30 and a condenser assembly 40, which together form a parallel horizontal condenser unit 50, and an evaporator assembly 60. The refrigerant control assembly has quick connection, leakless, self sealing rotatable connectors 22, 24, 26 at both opposite ends 27 and 29 of the refrigerant control assembly 20.

Parallel connection pipes 70 are connected to opposite ends 37 and 39 of compressor assembly 30 from connectors 22 on opposite the refrigerant control assembly 20. Connection pipes 70 include vapor pipes 72 and 74. Hot high pressure vapor pipe 72 delivers hot high pressure vapor from compressor assembly 30 to an oil separator in the refrigerant control assembly 20. Low pressure vapor return line 74 returns cool, low pressure vapor and any entrained liquid or oil to the compressor from a suction accumulator in the refrigerant control assembly 20. In addition, an oil return line 76 returns oil to the compressor from the oil separator in the refrigerant control assembly 20.

Alternatively, an oil separator is mounted in the compressor assembly.

Parallel connection pipes 80 are connected between condenser assembly 40 and the refrigerant control assembly 20. Pipes 80 include hot high pressure vapor pipe 82 and a cool liquid refrigerant pipe 84. Hot high pressure vapor pipe 82 is connected to the condenser 40 from the oil separator in the refrigerant control assembly 20. Liquid refrigerant pipe 84 is connected to condenser 40 and to a liquid accumulator in the refrigerant control assembly 20.

Assemblies 20, 30 and 40 and connecting pipes 70 and 80 complete the parallel horizontal condenser unit 50.

Parallel pipes 90 connect the refrigerant control assembly to the evaporator assembly 60. Pipes 90 include liquid refrigerant pipe 92 and spent vapor return pipe 94. Pipe 92 delivers cool liquid refrigerant to the evaporator 60 from a liquid refrigerant filter and sub cooler in the refrigerant control assembly 20. Pipe 94 returns spent vapor from the evaporator 60 through the sub cooler to a suction accumulator in the refrigerant control assembly 20.

Pipe 92 connects to an inlet of an expansion valve and a refrigerant distributor in the evaporator assembly. Pipe 94 connects to a refrigerant evaporator pressure regulator valve in an outlet of the evaporator 60. Wires are connected between the refrigerant control assembly 20 and stepper motors which control the expansion valve and evaporator pressure regulator valve on the evaporator 60. Wires are connected between the refrigerant control assembly 20 and temperature sensors at the inlet and outlet of the evaporator.

Alternatively, the expansion valve and evaporator pressure regulator valve may be mounted in the refrigerant control assembly.

Figure 2:
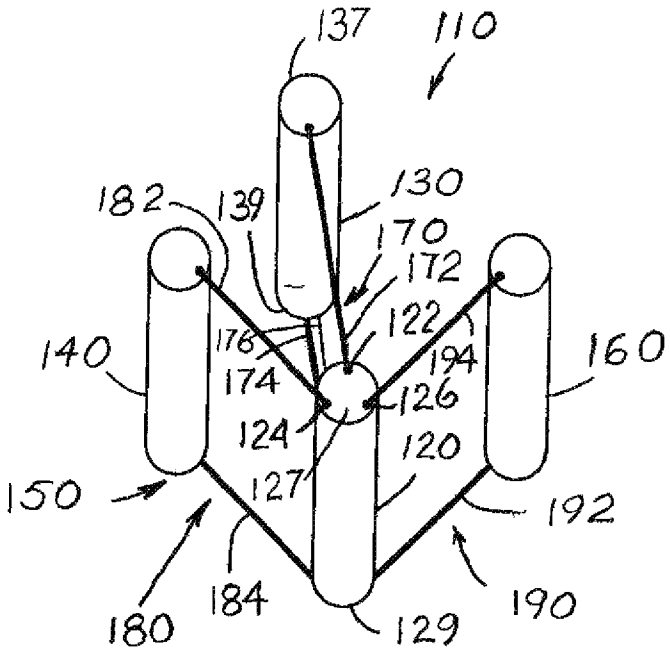
FIG. 2 schematically shows parallel vertical arrangements of refrigeration components.

FIG. 2 schematically shows a parallel vertical arrangement 110 of refrigerant components. Components include a refrigerant control assembly 120, a compressor assembly 130 and a condenser assembly 140, which together form a parallel vertical condenser unit 150, and an evaporator assembly 160. The refrigerant control assembly has quick connection, leakless, self sealing rotatable connectors 122, 124, 126 at both opposite ends 127 and 129 of the refrigerant control assembly 120.

Parallel connection pipes 170 are connected to opposite ends 137 and 139 of compressor assembly 130 from connectors 122 on opposite the refrigerant control assembly 120. Connection pipes 170 include vapor pipes 172 and 174. Hot high pressure vapor pipe 172 delivers hot high pressure vapor from compressor assembly 130 to an oil separator in the refrigerant control assembly 120. Low pressure vapor return line 174 returns cool, low pressure vapor and any entrained liquid or oil to the compressor from a suction accumulator in the refrigerant control assembly 120. In addition, an oil return line 176 returns oil to the compressor from the oil separator in the refrigerant control assembly 120.

Alternatively, an oil separator is mounted in the compressor assembly.

Parallel connection pipes 180 are connected between condenser assembly 140 and the refrigerant control assembly 120. Pipes 180 include hot high pressure vapor pipe 182 and a cool liquid refrigerant pipe 184. Hot high pressure vapor pipe 182 is connected to the condenser 140 from the oil separator in the refrigerant control assembly 120. Liquid refrigerant pipe 184 is connected to condenser 140 and to a liquid accumulator in the refrigerant control assembly 120.

Assemblies 120, 130 and 140 and connecting pipes 160, 170 and 180 complete the parallel vertical condenser unit 150.

Parallel pipes 190 connect the refrigerant control assembly to the evaporator assembly 160. Pipes 190 include liquid refrigerant pipe 192 and spent vapor return pipe 194. Pipe 192 delivers cool liquid refrigerant to the evaporator 160 from a liquid refrigerant filter in the refrigerant control assembly 120. Pipe 194 returns spent vapor from the evaporator 160 to a suction accumulator in the refrigerant control assembly 120.

Pipe 192 connects to an inlet of an expansion valve in the evaporator assembly. Pipe 194 connects to a refrigerant pressure control valve in an outlet of the evaporator 160. Wires are connected between the refrigerant control assembly 120 and stepper motors which control the expansion valve and pressure control valve on the evaporator 160. Sensor wires are connected between the refrigerant control assembly 120 and temperature sensors at the inlet and outlet of the evaporator 160. Alternatively, the expansion valve and refrigerant pressure control valve may be mounted in the refrigerant control assembly 120.

In the embodiments shown in FIGS. 1 and 2, hermetic rotatable refrigerant pipes 70, 80 and 90 and 170, 180 and 190 may be used in a flexible monoblock refrigeration configuration in which the pipes extend through the refrigerant control assembly 20 and 120 and through the components before connection to the components and to the subassemblies within the refrigerant control assembly so that the pipes may be twisted while the components are arranged in parallel arrangements.

Figure 3:
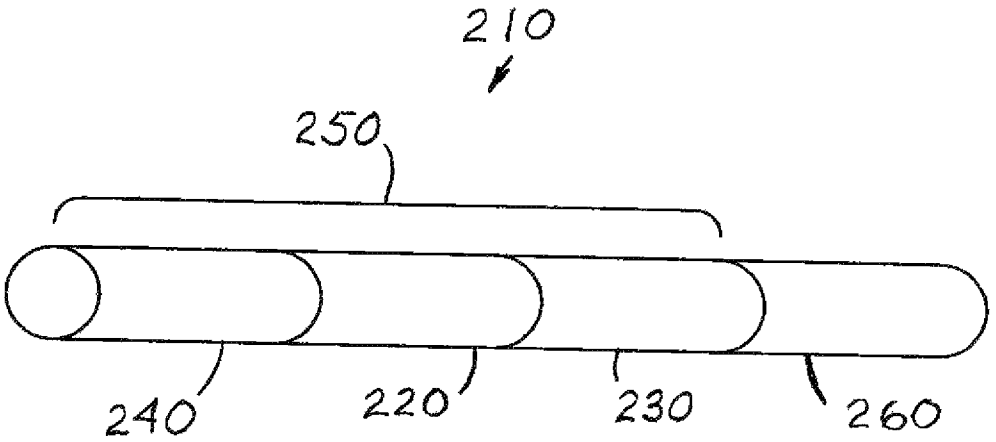
FIG. 3 schematically shows a linear horizontal arrangement of refrigeration components.

FIG. 3 schematically shows a linear horizontal arrangement 210 of refrigerant components. Components include a refrigerant control assembly 220, a compressor assembly 230 and a condenser assembly 240, which together form a linear horizontal condenser unit 250, and an evaporator assembly 260. The refrigerant control assembly 220 has quick connection, leakless, self sealing rotatable connectors at both opposite ends.

Parallel connection pipes are connected to an end of compressor assembly 230 from connectors on an adjacent end of the refrigerant control assembly 220. Connection pipes include two vapor pipes. A hot high pressure vapor pipe delivers hot high pressure vapor from compressor assembly 230 to an oil separator in the refrigerant control assembly 220. A low pressure vapor return line returns cool, low pressure vapor and any entrained liquid or oil to the compressor 230 from a suction accumulator in the refrigerant control assembly 220. In addition, an oil return line returns oil to the compressor from the oil separator in the refrigerant control assembly 220. Alternatively, an oil separator is mounted in the compressor assembly 230.

Parallel connection pipes are connected between condenser assembly 240 and the refrigerant control assembly 220. Pipes include a hot high pressure vapor pipe and a cool liquid refrigerant pipe. The hot high pressure vapor pipe is connected to the condenser 240 from the oil separator in the refrigerant control assembly 220. A liquid refrigerant pipe is connected to condenser 240 and to a liquid accumulator in the refrigerant control assembly 20.

Assemblies 220, 230 and 240 and connecting pipes and complete the horizontal linear condenser unit 250.

Pipes connect the refrigerant control assembly 220 to the evaporator assembly 260. Pipes include a liquid refrigerant pipe and a spent vapor return pipe. One pipe delivers cool liquid refrigerant to the evaporators 60 from a liquid refrigerant filter in the refrigerant control assembly 220. The other pipe returns spent vapor from the evaporator 260 to a suction accumulator in the refrigerant control assembly 220. The liquid refrigerant pipe connects to an inlet of an expansion valve in the evaporator assembly 260. The vapor return pipe connects to a refrigerant pressure control valve in an outlet of the evaporator 260. Wires are connected between the refrigerant control assembly 220 and stepper motors which control the expansion valve and pressure control valve on the evaporator 260. Wires are connected between the refrigerant control assembly 220 and temperature sensors at the inlet and outlet of the evaporator. Alternatively, the expansion valve and refrigerant pressure control valve may be mounted in the refrigerant control assembly 220.

Figure 4:
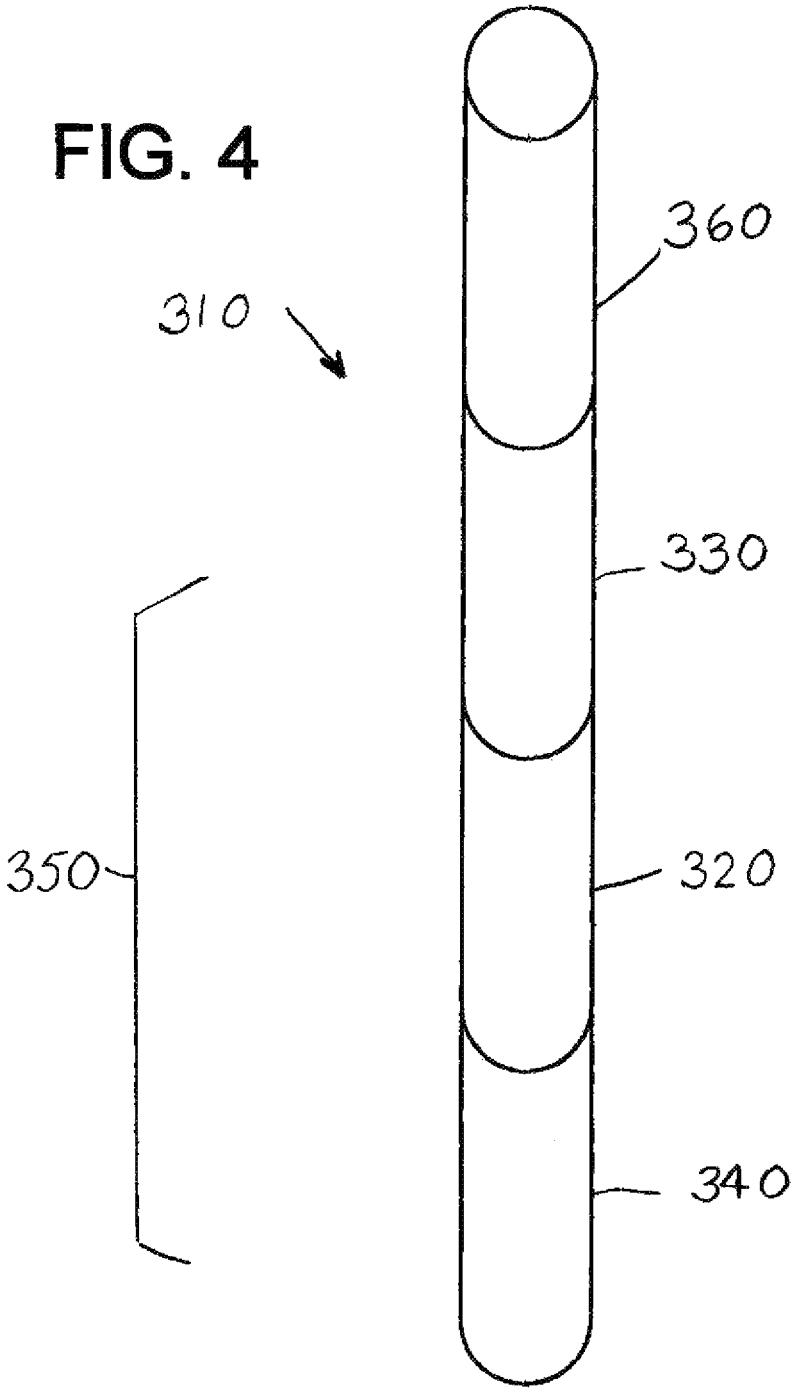
FIG. 4 schematically shows a vertical linear arrangement of refrigeration components.

FIG. 4 schematically shows a linear vertical arrangement 310 of refrigerant components. Components include a refrigerant control assembly 320, a compressor assembly 330 and a condenser assembly 340, which together form a linear vertical condenser unit 350, and an evaporator assembly 360. The refrigerant control assembly 320 has quick connection, leakless, self sealing rotatable connectors at both opposite ends.

Parallel vertical connection pipes are connected to an end of compressor assembly 330 from connectors on an adjacent end of the refrigerant control assembly 320. The connection pipes include first and second vapor pipes. A hot high pressure vapor pipe delivers hot high pressure vapor from compressor assembly 330 to an oil separator in the refrigerant control assembly 320. A low pressure vapor return line returns cool, low pressure vapor and any entrained liquid or oil to the compressor 330 from a suction accumulator in the refrigerant control assembly 320. In addition, an oil return line returns oil to the compressor 330 from the oil separator in the refrigerant control assembly 320. Alternatively, an oil separator is mounted in the compressor assembly.

Parallel vertical connection pipes are connected between condenser assembly 340 and the refrigerant control assembly 320. The vertical connection pipes include a hot high pressure vapor pipe and a cool liquid refrigerant pipe. The hot high pressure vapor pipe is connected to the condenser 340 from the oil separator in the refrigerant control assembly 320. The liquid refrigerant pipe is connected to condenser 340 and to a liquid accumulator in the refrigerant control assembly 320.

Assemblies 320, 330 and 340 and connecting pipes complete the linear vertical condenser unit 350.

Parallel vertical pipes connect the refrigerant control assembly 320 to the evaporator assembly 360. The vertical refrigerant pipes include a liquid refrigerant pipe and a spent vapor return pipe. One pipe delivers liquid refrigerant to the evaporator 360 from a liquid refrigerant filter in the refrigerant control assembly 320. The other pipe returns spent vapor from the evaporator 360 to a suction accumulator in the refrigerant control assembly 320.

The liquid pipe connects to an inlet of an expansion valve in the evaporator assembly 360. The vapor pipe connects to a refrigerant pressure control valve in an outlet of the evaporator 360. Wires are connected between the refrigerant control assembly 320 and stepper motors which control the expansion valve and pressure control valve on the evaporator 360. Sensor wires are connected between the refrigerant control assembly 320 and temperature sensors at the inlet and outlet of the evaporator. Alternatively, the expansion valve and refrigerant pressure control valve may be mounted in the refrigerant control assembly 320.

Figure 5:
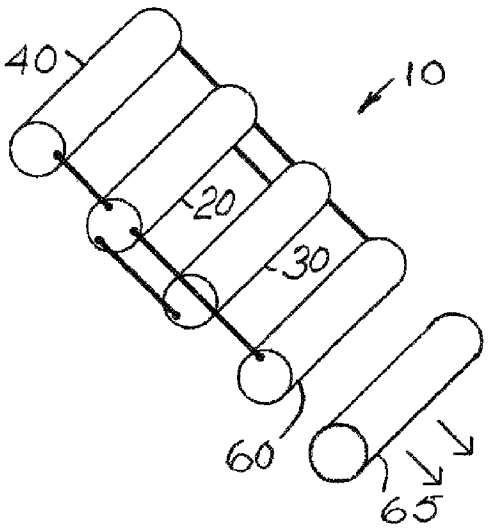
FIG. 5 schematically shows a parallel arrangement of refrigeration components.

FIG. 5 shows a parallel horizontal arrangement 10 of a refrigerant control assembly 20, a compressor assembly 30, a condenser assembly 40, and an evaporator assembly 60 with an addition of an evaporator fan assembly 65 in parallel planes with the other components.

Figure 6:
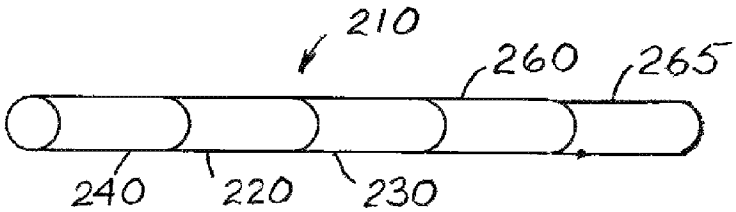
FIG. 6 schematically shows a linear arrangement of refrigeration components.

FIG. 6 shows a linear horizontal arrangement 210 of a refrigerant control assembly 220, a compressor 230, a condenser 240 and an evaporator 260 with the addition of an evaporator fan assembly 265 in linear alignment with the components. The evaporator fan in this arrangement is an inline duct blower.

Figure 7:
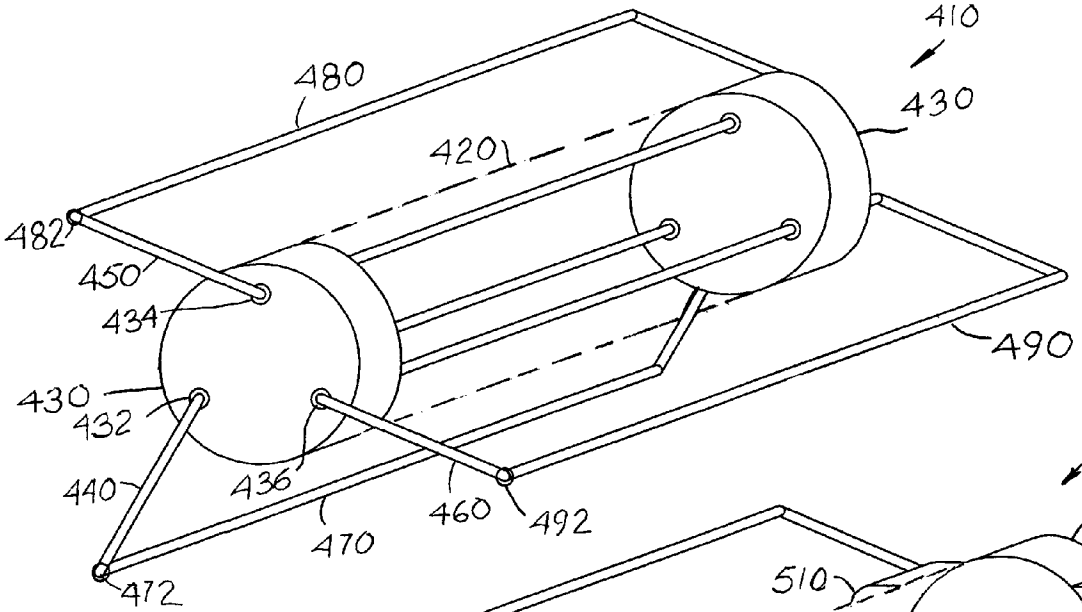
FIG. 7 is a schematic representation of a flexible monoblock refrigeration configuration.

FIG. 7 is a schematic representation of a flexible monoblock refrigeration configuration 410. As shown in FIG. 7, in the flexible monoblock refrigeration configuration 410 end connections 430 on a center refrigeration control assembly 420 have pipe bearing openings 432, 434 and 436 through which pipes 440, 450 and 460 extend to connect refrigeration components 470, 480 and 490, such as compressors and drivers, condensers and evaporators to refrigeration assemblies such as oil separators, liquid accumulators and suction accumulators within a refrigeration control assembly 420.

As shown in FIG. 7, the refrigerant pipes 440, 450 and 460 extend through refrigerant control assembly 420 and bearing openings 432, 434, 436 and similar openings 472, 482 and 492 and component assemblies 470, 480 and 490 before connecting opposite ends of the pipes 440, 450, 460 to elements in the component assemblies 470, 480 and 490 and to assemblies in the refrigeration control assembly 420. That allows parallel sections of the pipes to twist without bending the pipes or restricting passages in the pipes, while relatively relocating refrigeration components and control assemblies 470, 480, 490 and 420 in parallel planes.

Figure 8:
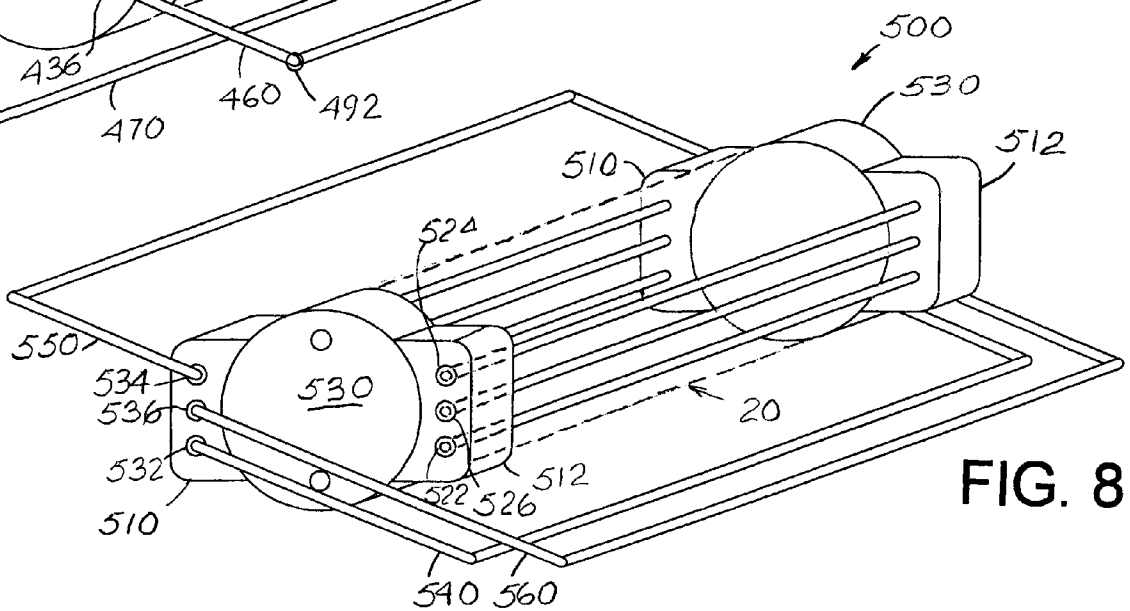
FIG. 8 is a schematic representation of a flexible monoblock refrigeration configuration with optional split ports.

FIG. 8 is a schematic representation of a flexible monoblock refrigeration configuration 500 with optional split ports. As shown in FIG. 8, split ports 510 and 512 are provided on end connections 530 of the refrigerant control assembly 520. Connection pipes extend through bearing openings 532, 534 and 536 and through one or all ports 522, 524 and 526 to connect additional components in the form of compressors and drivers, condensers and evaporators to the refrigerant control assembly 500. Refrigerant pipes 540, 550 and 560 and additional similar pipes extend through the bearing openings in the split ports to connect the refrigeration components to the refrigeration control assembly 520.

Figure 9:
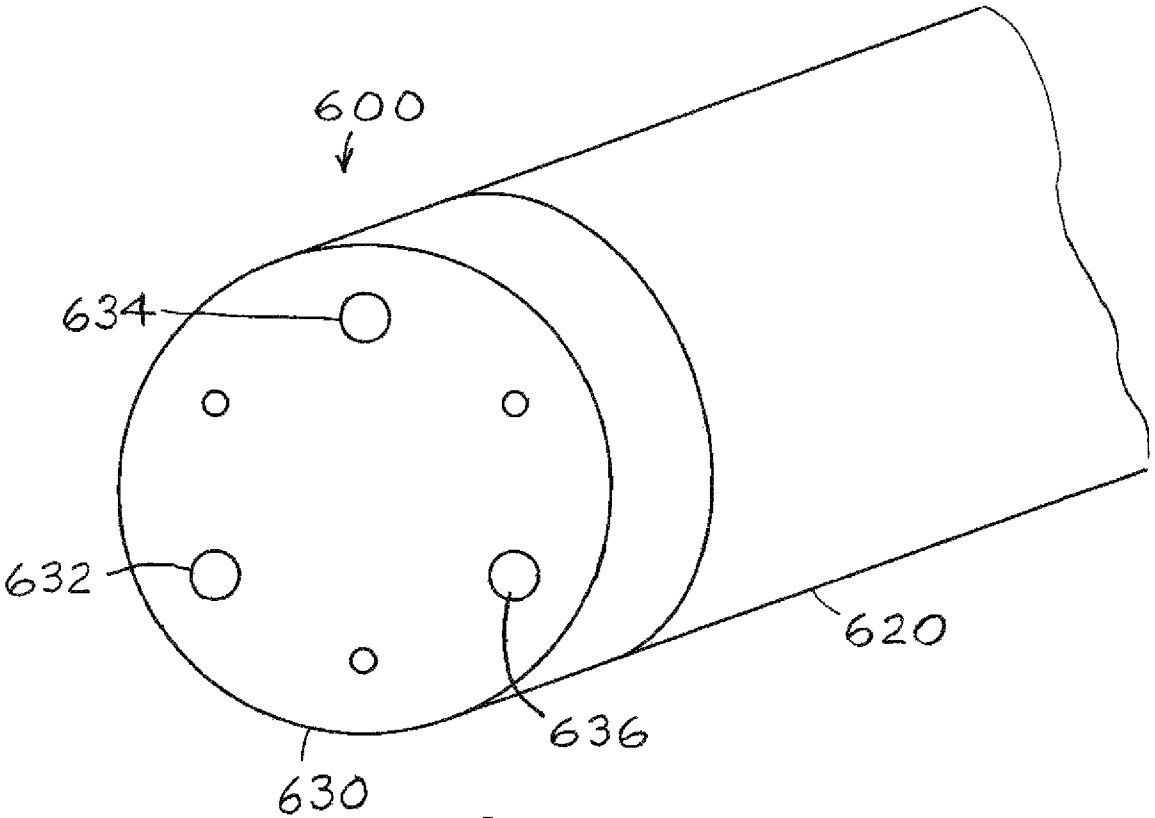
FIG. 9 is a detail of end connections for a flexible monoblock refrigeration configuration.

FIG. 9 is a detail of end connections for a flexible monoblock refrigeration configuration 600. As shown in FIG. 9, quick disconnect self sealing joints 632, 634 and 636 replace the journal type pipe bearing openings in ends 630 of the refrigeration control assembly 620. The quick disconnect self sealing joints 632, 634 and 636 allow connections of ends of refrigerant pipes 640, 650 and 660 in any direction, thus allowing repositioning of components 670, 680 and 690 in any parallel position relative to refrigeration control assembly 620 when installing a heat transfer or refrigeration system.

Figure 10:
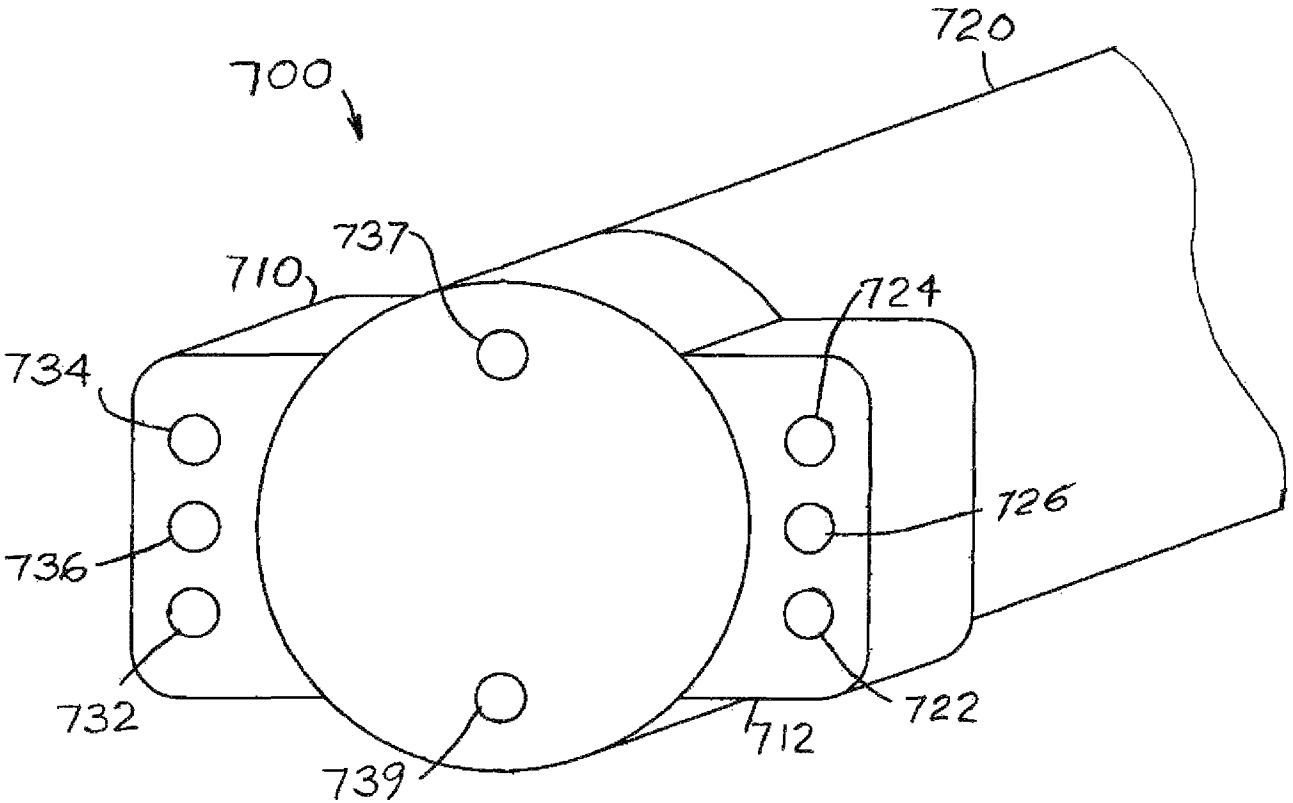
FIG. 10 is a detail of end connections for a flexible monoblock refrigeration configuration with optional split ports.

FIG. 10 is a detail of end connections for a flexible monoblock refrigeration configuration 700 with optional split ports 710 and 712. As shown in FIG. 10, quick disconnect self sealing joints 722, 724, 726, 732, 734 and 736 replace pipe bearing openings 522, 524, 526, 532, 534 and 536 split port connections.

Port 732 provides one half of a quick disconnect self sealing connector to a compressor and driver. A similar port at the opposite end provides one half of a quick disconnect self sealing connector to parallel pipes for connection to the compressor and driver subassembly.

Quick disconnect joint 734 and a similar joint at an opposite end of refrigerant control assembly 720 connect parallel pipes 780 with complementary quick disconnect joints to the condenser assembly.

Quick disconnect joint 736 and a similar joint at the opposite end of the refrigerant control assembly connect refrigerant pipes with complementary quick disconnect joints to the evaporator.

Quick disconnect joints 722 and a similar joint connect parallel pipes to a secondary compressor.

Quick disconnect joint 724 and a similar joint connect parallel pipes to a secondary condenser.

Quick disconnect joint 726 and a similar joint connect parallel pipes with complementary quick disconnect joints to slave evaporators operating at the same temperature as the evaporator connected to quick disconnect joint 736.

Optional additional quick disconnect self sealing joints 737 and 739 and similar joints at the opposite end of assemblies and pipes with complementary self sealing joints connect the refrigeration control assembly 720 respectively to an independent condenser unit and to an independent evaporator operating at a different temperature.

Figure 11:
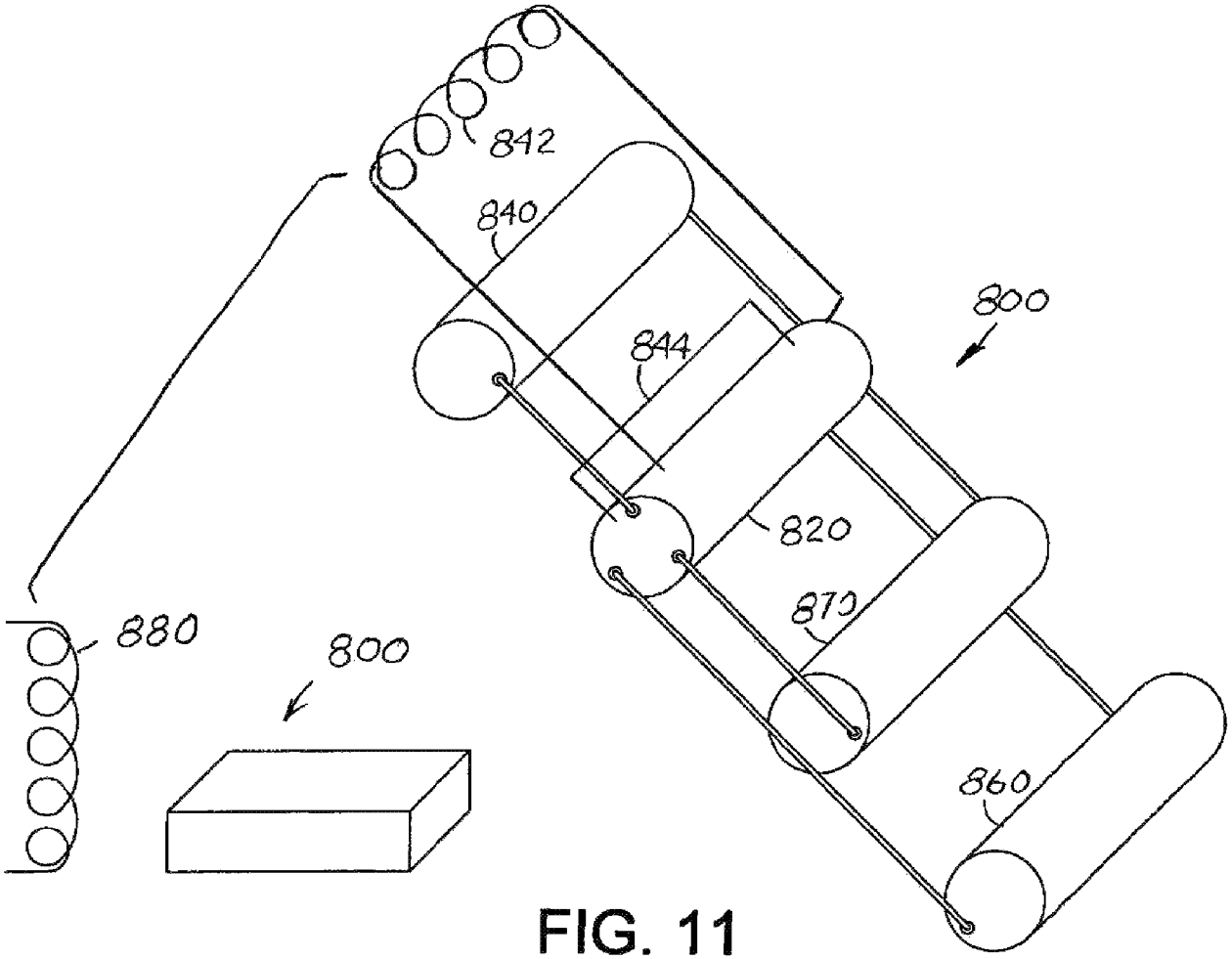
FIG. 11 is a detail of a refrigeration unit as shown in FIG. 1 with an air cooled condenser and a water cooled condenser.

FIG. 11 is a refrigeration system 800 for marine use with a refrigeration control assembly 820, a compressor and driver 870, an air-cooled finned condenser 880 and an evaporator 860. An additional water cooled condenser 842 is connected to the refrigerant control assembly 820. A bypass 844 is connected to the refrigerant control assembly 820 to bypass the air-cooled condenser when the system is installed on containers or spaces below deck, or to bypass the water cooled condenser when the system is installed on containers or spaces above deck.

Figure 12:
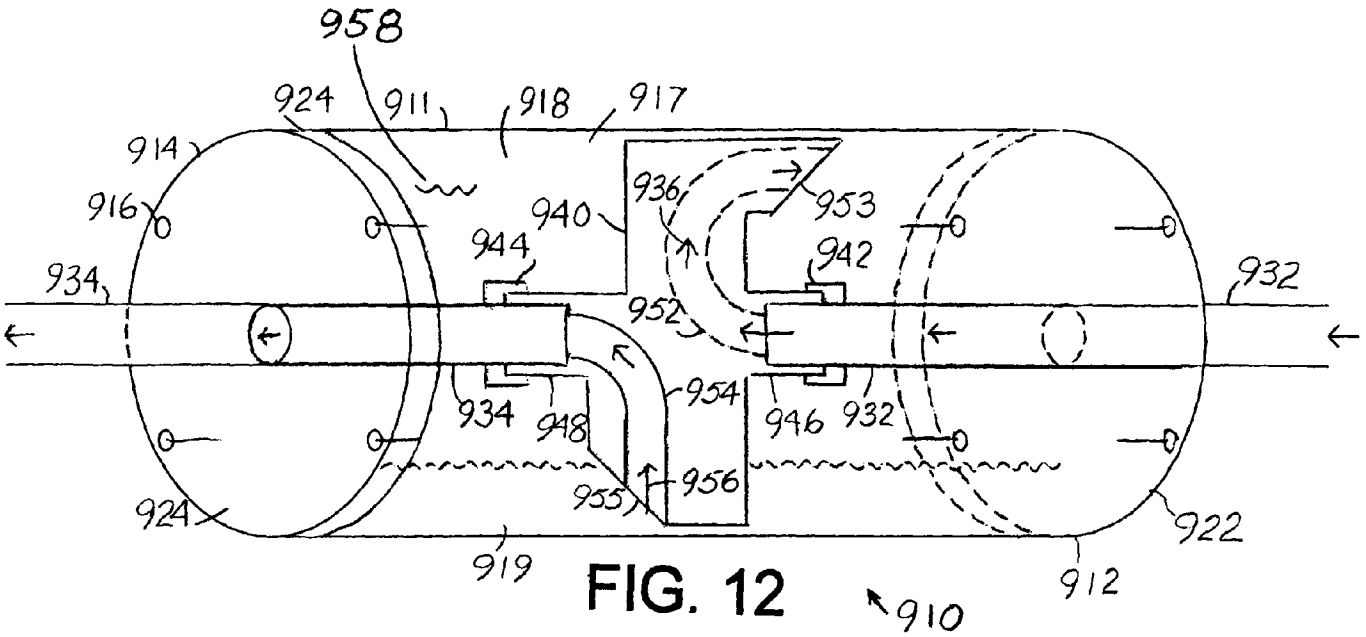
FIG. 12 is a cross sectional side view of a rotatable horizontal liquid accumulator.
Figure 13:
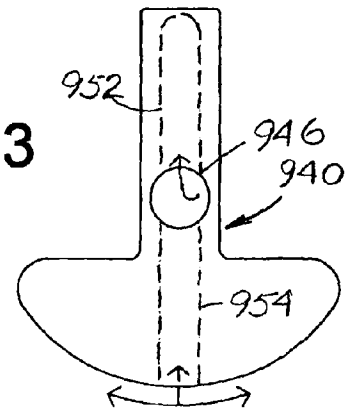
FIG. 13 is an end view of the pendulum in a rotatable horizontal liquid accumulator.

FIG. 12 is a cross sectional side view of a rotatable horizontal liquid accumulator 910. FIG. 13 is an end view of the pendulum 940 in the rotatable horizontal liquid accumulator 910. A rotatable horizontal liquid accumulator 910 is shown in FIG. 12 has a cylindrical body 911 with lids 912 and 914 bolted 916 on inlet end 922 and outlet end 924, respectively. Liquid refrigerant inlet pipe 932 from a condenser is rigidly joined to inlet lid 912, such as by brazing. Liquid refrigerant outlet line 934 is rigidly joined to outlet lid 914, such as by brazing, for example.

A pendulum 940 is placed in the cylindrical body 911. Seals 942, 944 are fixed on projecting ends 946, 948 of pendulum body 940. Liquid refrigerant pipes 932, 934 are pushed through seals 942, 944 into the projecting ends 946, 948. Incoming liquid 936 from a condenser flows from pipe 932 through internal tube 952 to the top of pendulum 940 and out through a 45° opening 953 into the upper portion 917 of sealed internal chamber 918. The 45° opening 953 increases outlet dimensions, providing less resistance to liquid flow. Internal tube 954 in pendulum 940 has a 45° opening 955 to draw liquid refrigerant 956 from the lower part 919 of sealed chamber 918. Vapor 958 with bubbles, if any, in incoming pipe 932 and internal tube 952 remains in the upper part 917 of chamber 918. Bolts 916 on lids 912 and 914 allow removal of the lids to clean and refurbish the pendulum 940 and chamber 918. The cylindrical body 911 and the pendulum 940 and its internal liquid lines and outlet and inlet 953 and 955 allow the liquid accumulator to be rotated to any position.

Figure 14:
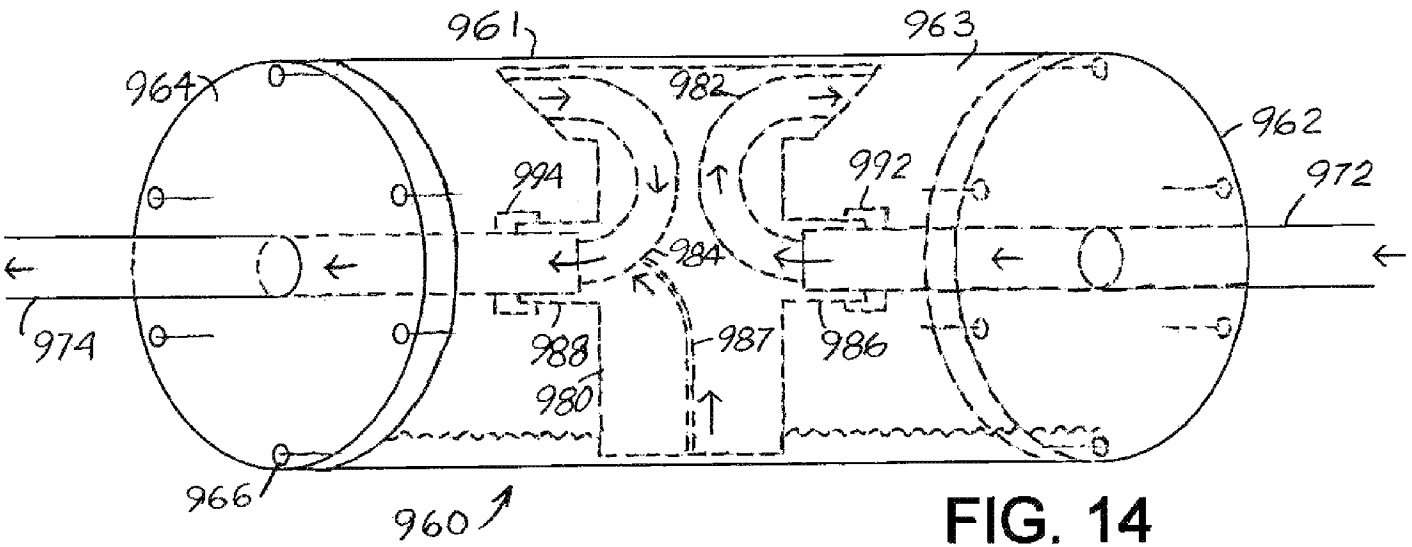
FIG. 14 is a cross section from a rotatable horizontal suction accumulator.

FIG. 14 is a cross section from a rotatable horizontal suction accumulator. The rotatable horizontal suction accumulator 960 shown in FIG. 14 has inlet and outlet lids 962 and 964, which are bolted 966 to ends of the cylindrical accumulator 960. Inlet refrigerant vapor pipe 972 from an evaporator extends through and is fixed to lid 962, such as by brazing, for example. Outlet refrigerant vapor pipe 974 extends through and is similarly fixed to outlet lid 964.

Pendulum 980 has internal inlet 982 and outlet 984 flow lines and a small diameter liquid and oil suction line 987. Pendulum 980 has extensions 986, 988, which freely rotate on extended ends of refrigerant vapor pipes 972 and 974. Seals 992 and 994 are fixed on extensions 986 and 988 and receive the pushed-in vapor pipes 972 and 974 when lids 962 and 964 are bolted on ends of the cylindrical body 961 and the suction accumulator 960.

Semicircular internal vapor flow lines 982 and 984 deliver and withdraw vapor to and from opposite ends of accumulator chamber 963. Any oil and liquid in the returning vapor pipe 972 falls to a lower section of an upper portion of accumulator chamber 963. Suction from a compressor inlet attached to vapor outlet pipe 974 draws vapor from the second end of accumulator chamber 963 into interior semicircular vapor flow line 984. Low pressure in interior flow line 984 draws oil or liquid from a bottom portion of the suction accumulator chamber 963, into and through smaller internal tube 987 and into internal tube 984 and out through refrigerant vapor pipe 974 into a suction side of a compressor.

Figure 15:
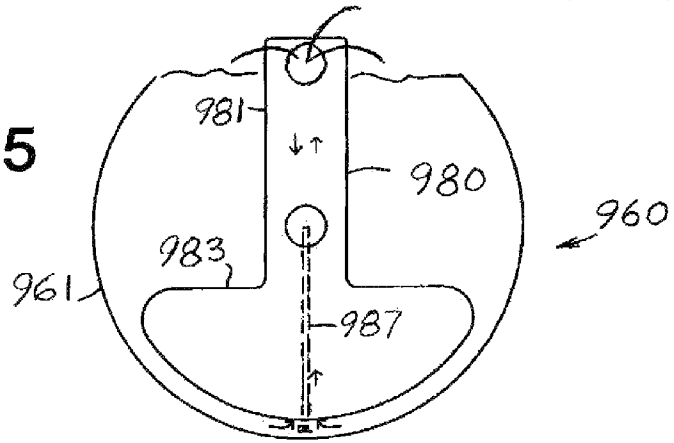
FIG. 15 is an end view of the pendulum within a rotatable horizontal suction accumulator.

FIG. 15 is an end view of the pendulum 980 within a rotatable horizontal suction accumulator 960. As shown in FIG. 15, the pendulum 980 has a smaller and lighter upper end 981 and a larger and heavier lower end 983 to maintain the vapor inlet and outlet 953 and 955 upward in an upper portion of suction accumulator chamber 962 and the internal oil tube 987 inlet in the bottom of the accumulator chamber 963. The cylindrical chamber 963, the pendulum, and the positioning of the internal lines 982, 984, 987 allow the rotatable horizontal suction chamber to be rotated into any position for installation of a heat transfer system.

Figure 16:
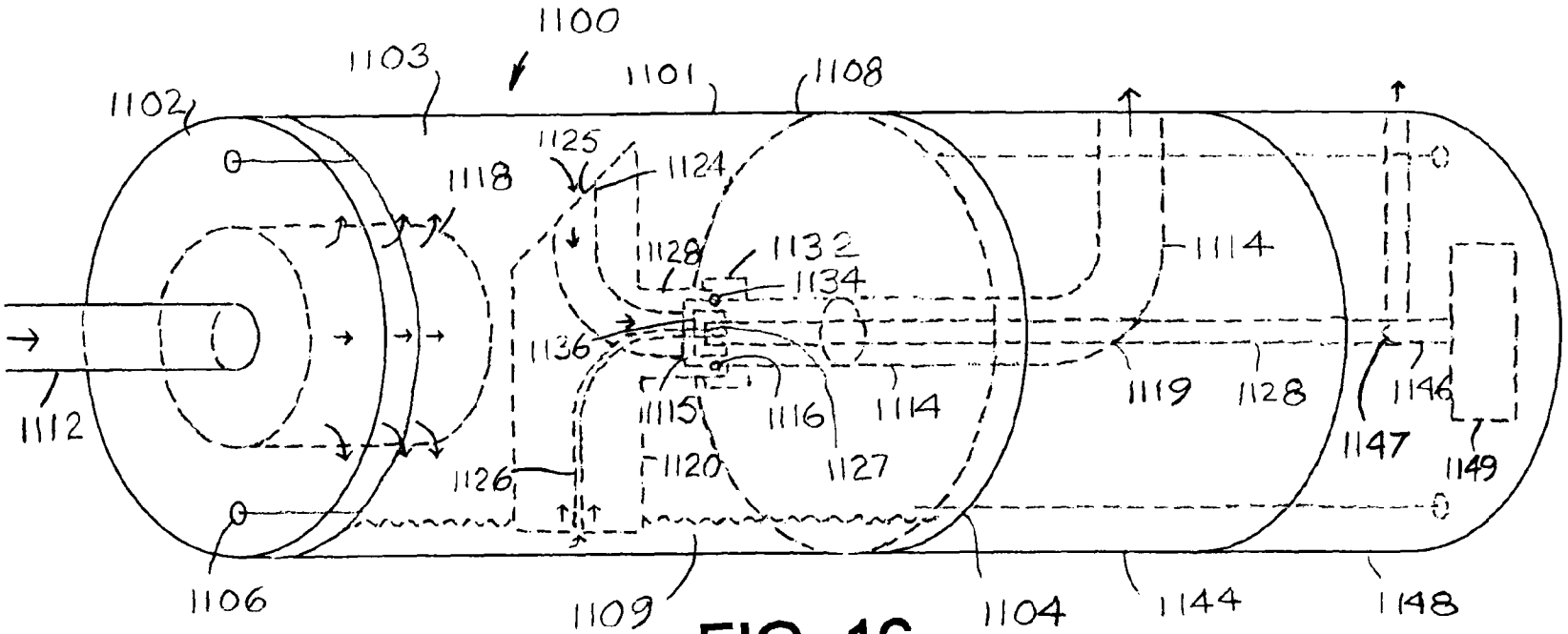
FIG. 16 shows a cross section of a serviceable variable oil flow output motorized rotatable horizontal coalescing oil separator.

FIG. 16 shows a cross section of a serviceable motor controlled variable oil flow output rotatable horizontal coalescing oil separator 1100. Oil separator 1100 has an inlet lid 1102 for receiving a high pressure hot refrigerant vapor pipe 1112 from a compressor high pressure port. Pipe 1112 is permanently jointed to lid 1102 by welding, brazing or other connection. A fine filter or screen 1118 in oil separator chamber 1103 at the end of pipe 1112 coalesces and removes entrained oil from the hot high pressure vapors entering the oil separator chamber 1103 and agglomerates and drops oil droplets into a bottom 1109 of separator chamber 1103. Pendulum 1120 has an internal hot vapor exit line 1124 with a 45° opening 1125. Vapor exit line 1124 extends through an axial extension 1128 of pendulum 1120. An oil recovery line 1126 extends from the base of the pendulum 1120 through a heavier lower portion of the pendulum 1120. The oil recovery line 1126 extends axially through the vapor outlet line 1124.

A hot high pressure vapor outlet pipe 1114 is mounted by fixing, welding or brazing in outlet lid 1104, which is bolted 1106 to an outlet end 1108 of the oil separator 1100.

Seal 1132 is fixed to the axial extension 1128 of pendulum 1120. Snap ring 1134 fits in an internal groove in extension 1128. High pressure hot vapor outlet pipe 1114 has a groove 1116 near its end 1115. The end 1115 of vapor outlet pipe 1114 is pushed into position through seal 1132 and snap ring 1134. Seal 1132 seals the pipe 1114 against vapor leakage, and snap ring 1134 prevents relative axial movement of pendulum extension 1128 on the end 1115 of vapor outlet pipe 1114. The high pressure vapor pipe extends outward to a quick connect sealing fitting to attach to a condenser inlet pipe.

Oil return pipe 1146 extends coaxially through high pressure vapor outlet pipe 1114 and is fixed and sealed 1119 where oil return pipe 1146 extends outward and separates from pipe 1114. Inner end 1117 of oil return pipe 1146 is pushed into a seal 1136. Seal 1136 is fixed on the end 1127 of vapor recovery line 1126, which is positioned in the middle of the connection between vapor line 1124 and end 1115 of vapor outlet pipe 1114. Oil from oil return pipe 1146 connected to the compressor helps to lubricate and seal the compressor.

In a simpler embodiment, the outlets of the oil return pipe 1146 and the high pressure vapor pipe 1114 are fixed in cylinder 1144, which is bolted to lid 1104. In a more complex construction, the oil return pipe 1146 passes through an optional stepper motor 1149 driven needle valve 1147 that regulates oil flow through oil return pipe 1146 to the compressor. The stepper motor driven needle valve 1147 is mounted in a cylinder 1148. The cylindrical body 1101 of the oil separator 1100, the pendulum 1120 and the vapor line 1124 and the vapor recovery line 1126 allows rotating the oil separator to any position when installing a heat transfer system.

Figure 17:
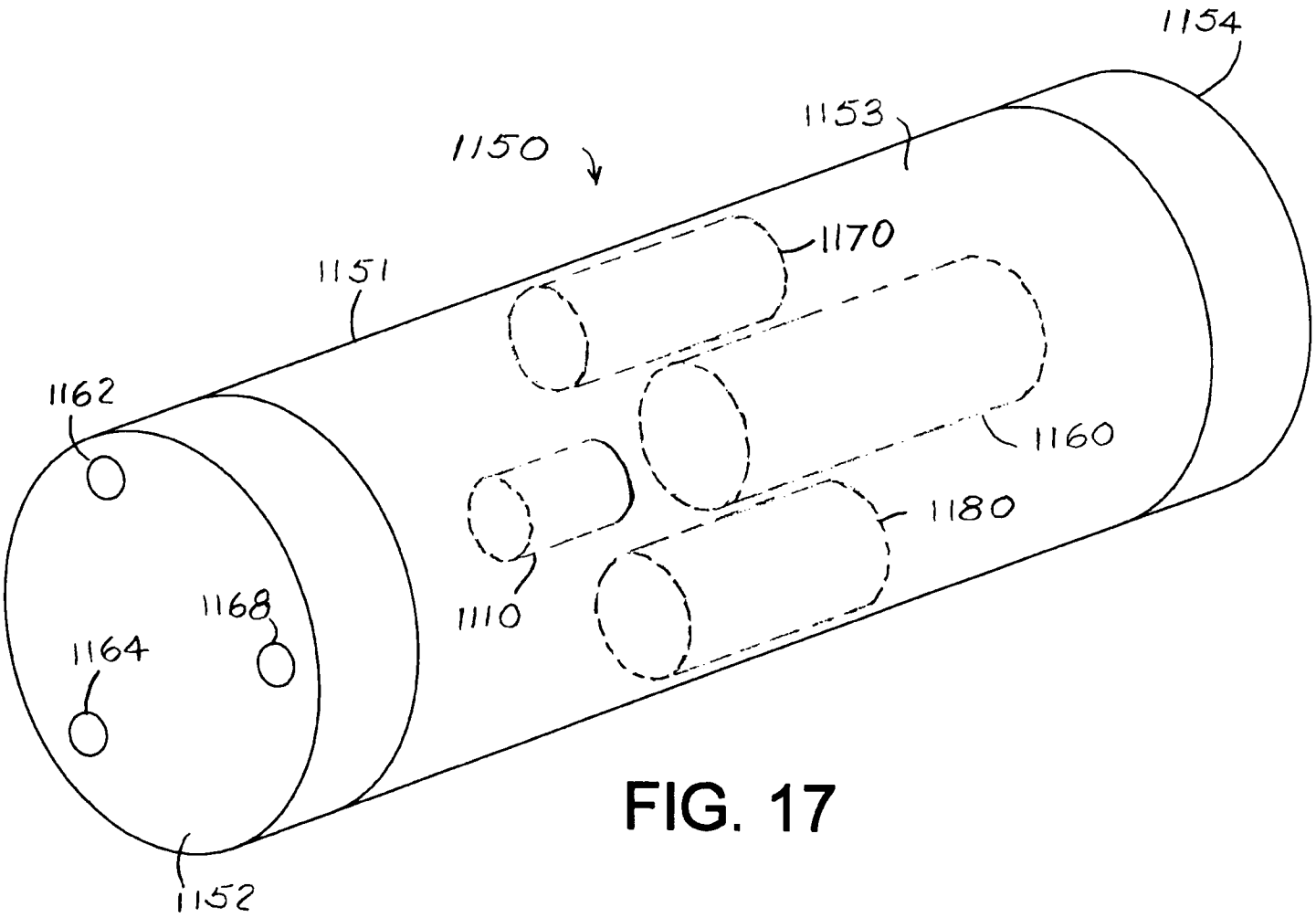
FIG. 17 is a schematic representation of a refrigerant control assembly.

FIG. 17 is a schematic representation of a refrigerant control assembly 1150. Assembly 1150 has opposite end lids 1152 and 1154 bolted to a cylindrical housing 1151, which may be rotated and positioned in any position.

The end lids 1152 and 1154 have quick connect leakless sealing couplings 1162, 1164 and 1168 respectively to one or more compressors, condensers and evaporators.

Internal piping in the housing connects the quick connect sealing couplings to internal elements. Among the internal elements are a rotatable horizontal liquid accumulator 1110, a rotatable horizontal suction accumulator 1160, a filter 1170, and a rotatable horizontal coalescing oil separator 1180.

Pendulums within cylindrical bodies of those elements allow rotation of the refrigerant control assembly to any position when installing a heat transfer system.

The housing 1151 of the refrigerant control assembly is filled with high density foam 1153 after the components and internal piping are installed for thermal, shock and sound insulation.

While the invention has been described with reference to specific embodiments, modifications and variations of the invention may be constructed without departing from the scope of the invention, which is defined in the following claims.

I claim:

1. Apparatus comprising:

a refrigeration assembly further comprising a refrigeration control assembly, a compressor assembly connected to the refrigeration control assembly, a condenser assembly connected to the refrigeration control assembly, an evaporator assembly connected to the refrigeration control assembly, wherein the compressor assembly, the condenser assembly, the evaporator assembly and the refrigeration control assembly are relocatable with respect to each other while remaining connected, a liquid accumulator having a cylindrical chamber with opposite first and second ends, a liquid refrigerant inlet pipe connected to the first end and a liquid refrigerant outlet pipe connected to the second end, a pendulum within the cylindrical chamber, the pendulum connected to the liquid refrigerant inlet pipe and the liquid refrigerant outlet pipe for rotating with respect to the liquid refrigerant inlet pipe and the liquid refrigerant outlet pipe, a first passageway in the pendulum and extending upward from the liquid refrigerant inlet pipe and opening at an upward extension into the chamber, a second passageway in the pendulum and ending downward from the liquid refrigerant outlet pipe and opening in a bottom of the chamber for flowing liquid from the bottom of the chamber through the second passageway and out through the liquid refrigerant outlet pipe.

2. The apparatus of claim 1, wherein the compressor assembly, the condenser assembly, the evaporator assembly and the refrigeration control assembly are relocatable parallel or longitudinal with respect to each other.

3. The apparatus of claim 2, wherein the compressor assembly, the condenser assembly, the evaporator assembly and the refrigeration control assembly are relocatable horizontally or vertically arranged with respect to each other.

4. The apparatus of claim 1, further comprising an evaporator fan assembly connected to the evaporator assembly or to the refrigerant control assembly.

5. The apparatus of claim 1, wherein the refrigeration control assembly has six ports, two ports each on the refrigeration control assembly for connecting to two ports on each of the compressor assembly, the condenser assembly and the evaporator assembly.

6. The apparatus of claim 5, wherein the ports and connectors are supplied with quick disconnect closing and sealing joints.

7. The apparatus of claim 5, wherein the refrigeration control assembly has eight ports, two ports each on the refrigeration control assembly for connecting to two ports on each of the compressor assembly, the condenser assembly, the evaporator assembly and two ports on the refrigeration control assembly for connecting to a secondary condenser coil for heat exchange with water.

8. The apparatus of claim 1, wherein the refrigeration control assembly has twelve ports, two ports each on the refrigeration control assembly for connecting to two ports on each of the compressor assembly, the condenser assembly, the evaporator assembly and two ports each on the refrigeration control assembly for connecting to a secondary compressor assembly, to a secondary condenser assembly and to a secondary slave evaporator assembly.

9. The apparatus of claim 1, wherein the refrigeration control assembly has sixteen ports, two ports each on the refrigeration control assembly for connecting to two ports on each of the compressor assembly, the condenser assembly and the evaporator assembly, two ports each on the refrigeration control assembly for connecting to a secondary compressor assembly, to a secondary condenser assembly and to a secondary slave evaporator assembly and two ports each on the refrigeration control assembly.

10. The apparatus of claim 9, wherein the two ports each on the refrigeration control assembly are for connecting to an independent condenser unit and to an independent evaporator unit.

11. The apparatus of claim 1, wherein the refrigeration control assembly has an internal liquid refrigerant filter, an internal liquid refrigerant accumulator, an internal suction accumulator, an internal oil separator and a thermal shock and sound insulator in a housing of the refrigeration control assembly.

12. Apparatus comprising:

a refrigeration assembly further comprising a refrigeration control assembly, a compressor assembly connected to the refrigeration control assembly, a condenser assembly connected to the refrigeration control assembly, an evaporator assembly connected to the refrigeration control assembly, wherein the compressor assembly, the condenser assembly, the evaporator assembly and the refrigeration control assembly are relocatable with respect to each other while remaining connected, a suction accumulator comprises a cylindrical chamber with first and second ends, a vapor inlet pipe connected to the first end and a vapor outlet pipe connected to the second end, a pendulum rotatable within the chamber, the pendulum having first and second ends in communication with the vapor inlet pipe and the vapor outlet pipe near the first and second ends of the chamber, and first passageway extending inward and upward from a first opening and the second passageway extending inward and upward from a second opening in the first and second ends of the chamber, respectively, the first passageway having the first opening connected to the vapor inlet pipe and the second passageway having the second opening connected to the vapor outlet pipe, the first passageway opening at an upward extension toward the first end of the chamber, and the second passageway opening at an upward extension toward the second end of the chamber.

13. The apparatus of claim 12, further having a liquid and oil pickup line connected between a lower end of the pendulum and the second passageway for flowing oil and liquid from a bottom of the chamber through the oil pickup line to the second passageway and the vapor outlet pipe.

14. Apparatus comprising:

a refrigeration assembly further comprising a refrigeration control assembly, a compressor assembly connected to the refrigeration control assembly, a condenser assembly connected to the refrigeration control assembly, an evaporator assembly connected to the refrigeration control assembly, wherein the compressor assembly, the condenser assembly, the evaporator assembly and the refrigeration control assembly are relocatable with respect to each other while remaining connected, wherein the refrigeration control assembly has an internal liquid refrigerant filter, an internal liquid refrigerant accumulator, an internal suction accumulator, an internal oil separator and a thermal shock and sound insulator in a housing of the refrigeration control assembly, wherein the internal oil separator has a cylindrical chamber having first and second ends, a high pressure hot vapor inlet line connected to the first end, a fine filter connected to the first end for filtering oil from the high pressure vapor and dropping oil to a bottom of the chamber, a high pressure vapor outlet line connected at a center of the second end of the chamber, a pendulum rotated near the second end of the chamber, the pendulum having a top and a bottom, a vapor passageway connected to an opening near the top of the pendulum and to the high pressure vapor outlet line, an oil pick up passageway connected to an opening at the bottom of the pendulum and passing through the high pressure vapor outlet line and passing out a center of the second end of the chamber.

15. The apparatus of claim 14, further comprising a stepper motor driven needle valve regulator at an outer end of the oil passageway for regulating oil output from the chamber.

16. The apparatus of claim 14, wherein at least one of the fluid passageways comprises an opening in the top of the pendulum and an opening in at least one of the first end and the second end for flowing fluid.

17. The apparatus of claim 14, wherein one of the fluid passageways has an opening at the bottom of the pendulum and an opening in one end of the chamber for flowing a liquid from a bottom of the chamber out of the chamber.

18. An apparatus comprising:

a refrigeration assembly, said refrigeration assembly comprising a refrigeration control assembly, a compressor assembly connected to the refrigeration control assembly, a condenser assembly connected to the refrigeration control assembly, an evaporator assembly connected to the refrigeration control assembly, wherein the compressor assembly, the condenser assembly, the evaporator assembly and the refrigeration control assembly are relocatable with respect to each other while remaining connected, the refrigeration assembly further comprising a fluid accumulator having a cylindrical chamber with first and second opposite ends, a fluid inlet line at the first end and a fluid outlet line at the second end, a pendulum within the cylindrical chamber, wherein the pendulum is rotated in the chamber and said pendulum has a top end that is lighter than a bottom end, the pendulum connected to the fluid inlet line and the fluid outlet line for rotating with respect to the fluid inlet line and the fluid outlet line, a first passageway in the pendulum and extending upward from the fluid inlet line and opening at an upward extension into the chamber, a second passageway in the pendulum and ending downward from the fluid outlet line and opening in a bottom of the chamber for flowing liquid from the bottom of the chamber through the second passageway and out through the fluid outlet line.

* * * * *